US005530532A

United States Patent [19]

Iino et al.

[11] Patent Number: 5,530,532

[45] Date of Patent: Jun. 25, 1996

[54] IMAGE FORMING APPARATUS USING INTERMEDIATE TRANSFER MEMBER HAVING SURFACE ROUGHNESS TO TONER SIZE RATIO

[75] Inventors: Shuji Iino, Muko; Toshimitsu Fujiwara, Kobe, both of Japan

[73] Assignee: Minolta Co., Ltd., Osaka, Japan

[21] Appl. No.: 299,347

[22] Filed: Sep. 1, 1994

[30] Foreign Application Priority Data

Sep. 3, 1993 [JP] Japan ..... 5-219830

[51] Int. Cl.[6] ..... G03G 15/10

[52] U.S. Cl. ..... 355/256; 355/275; 430/126

[58] Field of Search ..... 355/256–258, 355/271–275, 277; 430/111, 114, 126, 117; 118/651, 661, 659, 660

[56] References Cited

U.S. PATENT DOCUMENTS

| | | | |
|---|---|---|---|
| 4,259,428 | 3/1981 | Tsuneda | 430/115 |
| 4,737,433 | 4/1988 | Rimai et al. | 430/111 |
| 4,984,025 | 1/1991 | Landa et al. | 355/274 |
| 4,999,677 | 3/1991 | Landa et al. | 355/273 |
| 5,047,808 | 9/1991 | Landa et al. | 355/277 |
| 5,089,856 | 2/1992 | Landa et al. | 355/279 |
| 5,158,846 | 10/1992 | Bujese | 430/47 |
| 5,168,313 | 12/1992 | Hosaka et al. | 355/274 |
| 5,370,961 | 12/1994 | Zaretsky et al. | 430/126 |

FOREIGN PATENT DOCUMENTS

| | | |
|---|---|---|
| 0050475 | 3/1984 | Japan . |
| 0194272 | 8/1988 | Japan . |
| 0154086 | 7/1991 | Japan . |
| 0303869 | 10/1992 | Japan . |

*Primary Examiner*—Robert Beatty

*Attorney, Agent, or Firm*—Burns, Doane, Swecker & Mathis

[57] ABSTRACT

An image forming apparatus having an image carrying member onto which an electrostatic latent image is formed, a developing device that accommodates a liquid developer including toner particles for forming a toner image on the image carrying member by developing the electrostatic latent image, and an intermediate transfer member onto which .is transferred the toner image formed on the surface the image carrying member. The image on the surface of the intermediate transfer member is further transferred onto a recording medium. The intermediate transfer member surface has a mean roughness of 0.5–10 times greater than the volume-average particle size of the toner particles.

22 Claims, 3 Drawing Sheets

IMAGE FORMING APPARATUS USING INTERMEDIATE TRANSFER MEMBER HAVING SURFACE ROUGHNESS TO TONER SIZE RATIO

BACKGROUND OF THE INVENTION

FIELD OF THE INVENTION

The present invention relates to an image forming apparatus, and more specifically relates to an image forming apparatus using a liquid development method.

DESCRIPTION OF THE RELATED ART

Electrophotography can be broadly divided into dry process developing methods and wet process developing methods. Among these developing methods, a wet process developing method was invented by Metcalfe of Australia in 1955 which provides superior halftone characteristics for high definition by means of the small particle diameter of the toner particles, and easy adhesion of said particles to the copy.

Recently, reductions in the diameter of toner particles have occurred to satisfy demands for high accuracy images. In dry process developing methods, the realizable level of such reduction is a mean particle diameter of about 6–9 μm. However, in wet process developing methods wherein toner particles are disposed within a liquid, the realizable level of such reduction is in the submicron range, an advantage that cannot be obtained in a dry process developing method.

In typical wet process developing methods, a liquid developing material is used comprising toner particles containing a coloring agent which are dispersed within a insulating liquid.

On the other hand, methods for producing color images using the aforesaid wet process developing methods include image transfer methods using an intermediate transfer member such as are disclosed in U.S. Pat. Nos. 5,089,856, 5,047,808, 999677, 4984025, and 5,158,846.

In the aforesaid image transfer methods using an intermediate transfer member, an electrostatic latent image formed on the surface of a photosensitive member is developed by a liquid developer so as to form a toner image, and thereafter an electric field is formed between said photosensitive member and an intermediate transfer member, such that the toner image formed on the surface of said photosensitive member is once electrostatically transferred onto said intermediate transfer member via an insulative liquid medium within said liquid developer. Thereafter, the aforesaid toner image formed on the surface of the intermediate transfer member is transferred onto a copy sheet.

However, in the aforesaid image transfer methods using an intermediate transfer member, both the photosensitive member and the intermediate transfer member must be in contact with the aforesaid liquid medium in order to electrostatically transfer the toner image formed on the surface of the photosensitive member onto the intermediate transfer member via the insulative liquid medium disposed within the liquid developer. Thus, in order to achieve reliable contact between the photosensitive member and the intermediate transfer member via the liquid medium, both said members must be in pressure contact. Due to the aforesaid pressure contact between the photosensitive member and intermediate transfer member, the toner image formed on the surface of the photosensitive member is readily moved horizontally due to the force of the aforesaid pressure during transfer, thereby reducing the resolution of the ultimately obtained image.

SUMMARY OF THE INVENTION

A main object of the present invention is to provide an image forming apparatus using a liquid developing method and capable of producing image having excellent resolution.

A further object of the present invention is to provide an image forming apparatus capable of producing image having excellent resolution by preventing disruption of the toner image during transfer without loss of transfer efficiency in a liquid developing method using an intermediate transfer member.

A still further object of the present invention is to provide an image forming apparatus provided with an intermediate transfer member having a high transfer efficiency and excellent release characteristics relative to toner particles.

These objects of the present invention are achieved by providing an image forming apparatus comprising:

- an image carrying member on the surface of which is maintained an electrostatic latent image;
- a developing device that accommodates a developer including toner particles for forming a toner image by developing said electrostatic latent image;
- an intermediate transfer member onto which is transferred the toner image formed on the surface of the image carrying member and which is maintained thereon, a mean roughness of said intermediate transfer member surface is 0.5–10 times greater than the volume average particle size of the toner and
- a transfer device that transfer the toner image on the surface of the intermediate transfer member to a sheet.

These and other objects, advantages and features of the invention will become apparent from the following description thereof taken in conjunction with the accompanying drawings which illustrate a specific embodiment of the invention.

DETAILED DESCRIPTION OF THE PREFERRED EMBODIMENTS

Figure 1:
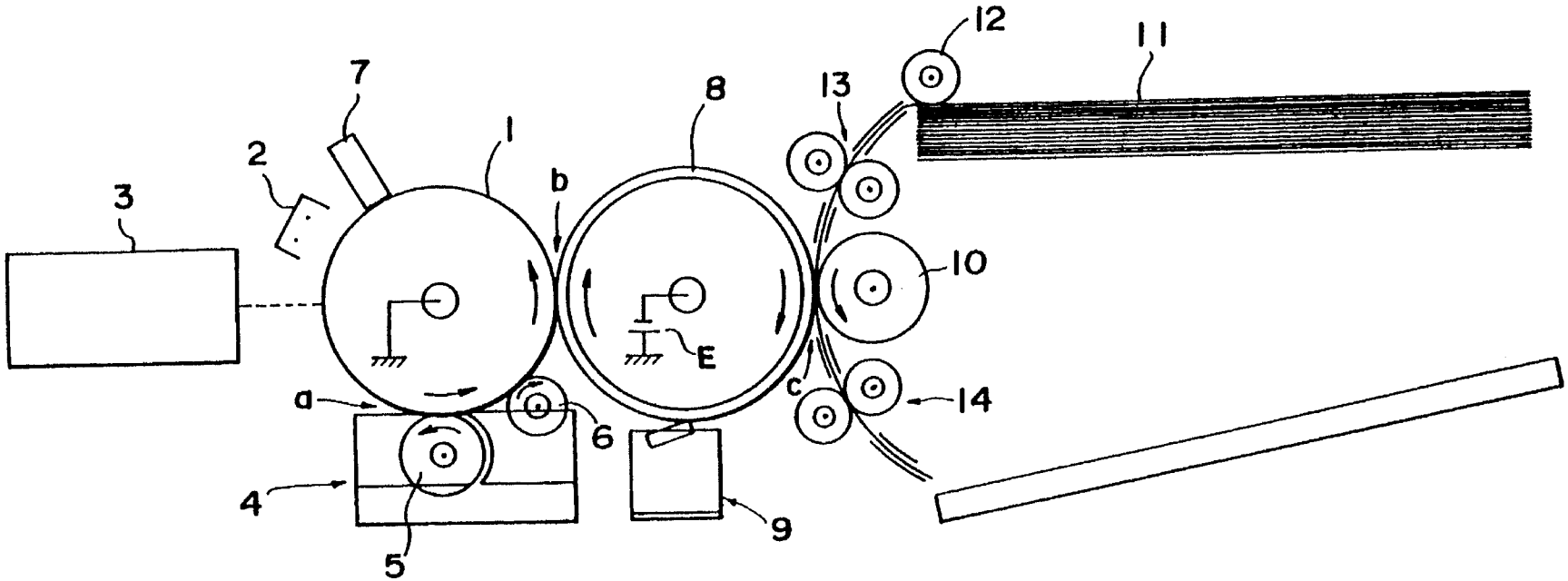
FIG. 1 is a brief illustration showing the monochrome image forming apparatus as an embodiment of the present invention.

In the image forming apparatus shown in FIG. 1, reference numeral 1 refers to a photosensitive drum used as-the electrostatic latent image carrying member, reference numeral 2 refers to a scorotron charger used as a charging device for uniformly charging the surface of the electrostatic latent image carrying member, reference numeral 3 refers to a laser beam scanner used as an exposure device for exposing an image on the latent image carrying member, reference numeral 4 refers to a developing device accommodating a liquid developer in an interior section thereof and provided with developing roller 5 and squeeze roller 6, reference numeral 7 refers to a discharger for discharging the residual electrical charge remaining on the surface of the latent image carrying member, reference numeral 8 refers to an intermediate transfer member, reference numeral 9 refers to a cleaning device, and reference numeral 10 refers to a transfer roller. The surface of photosensitive drum 1 is uniformly charged by scorotron charger 2, and the charged surface is subjected to light exposure via laser beam scanner 3 based on image information so as to form an electrostatic latent image on the surface of photosensitive drum 1. Then, liquid developer accommodated within developing device 4 is supplied via developing roller 5 to developing region [a] formed at the area where developing roller 5 and photosensitive drum 1 confront one another, so as to develop said electrostatic latent image to form a toner image on the surface of photosensitive drum 1. Subsequently, an excess liquid medium in the liquid developer adhering tO the surface of the photosensitive drum 1 is squeezed by squeeze roller 6, so as to regulate the toner image formed on the surface of photosensitive drum 1 into a state of slight containment in said liquid medium. This toner image is transported to a first transfer region [b] formed where photosensitive drum 1 and intermediate transfer member 8 confront one another via the rotation of said photosensitive drum 1 (primary transfer). Thereafter, the toner image maintained on the surface of intermediate transfer member 8 is transported to a second transfer region [c] formed at the area where intermediate transfer member 8 and transfer roller 10 confront one another via the rotation of intermediate transfer member 8, whereupon said toner image is thermally transferred via transfer roller 10 onto transfer sheet P (secondary transfer) fed thereto from paper supply device 11 via feed roller 12 and a pair of guide rollers 13 to produce a fixed image. At this time, transfer roller 10 is heated by a heating means not shown in the illustration. Following the previously described second transfer, the toner image may be fused on the transfer sheet P via a fixing device as necessary.

Surface of intermediate transfer member 8 is provided with a ten-point mean roughness Rz that is 0.5–10 times, and preferably 1–5 times greater than the volume-average particle size of the toner used. Use of an intermediate transfer member having the aforesaid roughness does not reduce transfer efficiency, and eliminates the problem of reduced resolution caused by disruption of the toner image during transfer.

Specifically, the surface layer of the intermediate transfer member is roughened by grinding to a ten-point mean roughness Rz that is 0.5–10 times greater than the volume-average particle size of the toner used.

Ten point mean roughness Rz is the difference, expressed by micrometer(μm), between the mean value of the heights of peaks from the highest to the 5th and the mean value of the depths of the valley bottoms from the deepest to the 5th as estimated in the direction of longitudinal magnification from the line running in parallel to the mean line and not crossing the roughness curve, in the part withdrawn from the roughness curve by the standard length.

The "mean line" is a straight line, in the part withdrawn from the roughness curve, to be determined such that the sum of the squares of the deviation from this straight line to the roughness curve is set to be minimum.

The "peak" means the highest point in a mountain in the roughness curve.

The "valley bottom" means the deepest point in a valley in the roughness curve.

Ten-point mean roughness Rz may be obtained from the following equation:

$$Rz = \frac{(R1 + R3 + R5 + R7 + R9) - (R2 + R4 + R6 + R8 + R10)}{5}$$

L:Standard length (2.5 mm)

R1,R3,R5,R7,R9:Heights of peaks from the highest to the fifth in the withdrawn part corresponding to the standard length L.

R2,R4,R6,R8,R10:Depths of the valley bottoms from the deepest to the fifth in the withdrawn part corresponding to the standard length L.

Ten-point mean roughness Rz is determined according to the method described in JIS standard B0601-1982.

The method of surface roughening is not limited to grinding using particles (grindstone particles), and other suitable means may be used to similar effect.

Examples of useable surface roughening methods include buff grinding, brush grinding, water grinding via the interposition of a liquid, liquid grinding, sandblasting via impact by high-speed particles, heat processing during the formation of the surface coating, solvent processes and the like. Roughness of the surface may be regulated by dispersing in the surface layer particles having a predetermined particle diameter.

Figure 2:
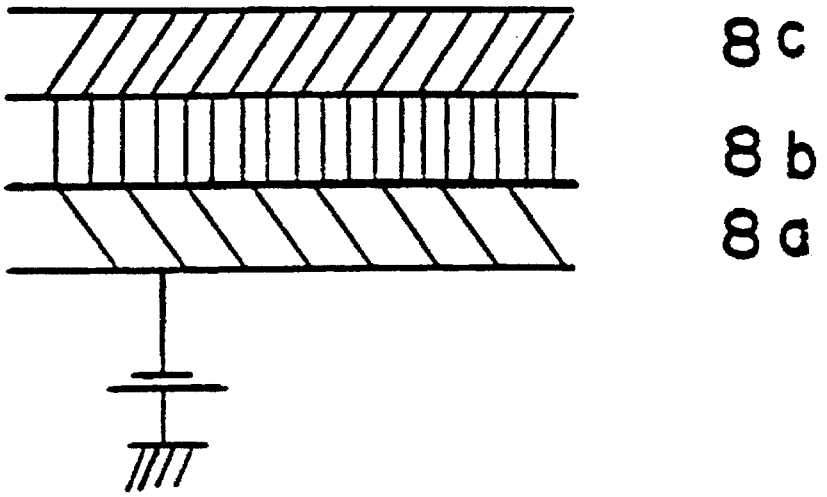
FIG. 2 is an brief illustration showing the structure of an intermediate transfer member.

The aforesaid intermediate transfer member 8 preferably comprises a sequential lamination of at least a substrate (support member) 8*a*, a cushion layer 8*b* formed on the substrate 8*a*, and a surface layer 8*c* formed on the cushion layer 8*b* as shown in FIG. 2.

Examples of useful materials to form a substrate are metal materials such as aluminum, iron, stainless steel and the like, or resins or paper or the like the surface of which has been at least subjected to electrically conductive processing.

Examples of useful cushion layers are rubber materials such as nitrile rubber (acrylonitrile-butadiene-copolymer), chloroprene rubber (polychloroprene), ethylene-propylene rubber (ethylene-propylene-terpolymer), silicone rubber (polysiloxane), butyl rubber (isoprene-isobutylenecopolymer), styrene rubber (styrene-butadienecopolymer), urethane rubber (polyurethane), chlorosulfonated polyethylene rubber, fluororubber (fluorohydrocarbon resin), epichlorohydrin rubber and the like to which is added conductive polymers such as conductive carbon, metal, polyacetylene, polyhydrol, polythiophene and the like. Cushioning characteristics may be improved by expanding the aforesaid materials so as to form localized air pockets. Laminate constructions of the aforesaid materials may be used to regulate cushioning characteristics and resistance. Uniform pressure contact between the intermediate transfer member and the photosensitive drum can be achieved by providing a cushion layer. Furthermore, electrostatic transfer is possible by means of providing electrical conductivity characteristics in said cushion layer.

Examples of useful surface layer materials are fluororesins such as polychlorotrifluoroethylene (ethylene chloride trifluoride: PCTFE), chlorotrifluoroethylene-ethylene copolymer (ethylene chloride trifluoride copolymer:ECTFE), polyvinylidenefluoride (vinylidenefluoride:PVDF), polyvinylfluoride (vinylfluoride: PVF), polytetrafluoroethylene (ethylene tetrafluoride: PTFE), tetrafluoroethylene-perfluoroalkyl vinyl ether copolymer (ethylene tetrafluoride-perfluoroalkoxyethylene copolymer: PFA), tetrafluoroethylene-hexafluoropropylene copolymer (ethylene tetrafluoride-propylene hexafluoride: FEP), tetrafluoroethylene-hexafluoropropylene-perfluoroalkylvinyl ether copolymer (ethylenetetrafluoride-propylenehexafluoride-perfluoroalkoxyethylene copolymer: EPE), tetrafluoroethylene-ethylene copolymer (ethylene tetrafluoride-ethylene copolymer: ETFE) and the like. Inclusion of fluororesin(s) in the surface layer makes it difficult for the toner particles to use to the surface of the intermediate transfer member during transfer from the intermediate transfer member to the recording sheet, thereby preventing a reduction in the transfer efficiency from the intermediate transfer member to the recording sheet. Electrically conductive particles may be added to the layer regulate resistance. The aforesaid fluororesins may be included in the surface layer as microparticles.

The liquid developer used in the image forming apparatus comprises at least a liquid medium used as a liquid carrier, and polymer microparticles (toner particles) incorporating a coloring agent. Other materials function-imparting agents such as charge-regulating agents, dispersion agents, dispersion stabilizers and the like.

The volume-average particle size of the aforesaid toner particles is desirably regulated at 0.5–5.0 μm , and preferably regulated to 0.7–4.0 μm. Furthermore, 80% of the volume of the total weight of toner particles is desirably regulated to ±1 μm of the volume-average particle size, and preferably regulated to within a range of ±0.5 μm. In the embodiment, the volume-average particle size and particle diameter distribution is measured using a particle size distribution measuring device (model SALD-1100 manufactured by Shimazu Seisakusho Ltd.).

Polymer microparticles produced by dry process manufacturing methods and wet process manufacturing methods may be used as the aforesaid toner particles.

Examples of useful dry process manufacturing methods include dry process pulverization methods, spray drying methods and the like. Examples of useful wet process manufacturing methods include in-solvent pulverization methods, suspension polymerization, emulsion polymerization methods, nonaqueous dispersion polymerization methods, seed polymerization methods, and emulsion-dispersion-granulation methods which produce polymer microparticles. In particular, polymer microparticles produced by emulsion-dispersion-granulation methods or spray drying methods can be obtained using many types of resins with respect to readily regulatable molecular weight, resin blendability, sharpness of particle diameter distribution and the like.

Emulsion dispersion methods dissolve polymers in a nonaqueous solution of an organic solvent medium to produce a polymer solution which is dispersed as an emulsion in an aqueous dispersion, thereby forming an emulsion of the O/W type (i.e., oil-in-water type emulsion). The O/W type emulsion is heated as it is mixed so as to vaporize the organic solvent, whereupon the polymer particles are extracted to obtain the polymer microparticles.

Spray drying methods dissolve polymers in an organic solvent medium in which are dispersed coloring agent or like constituent(s) so as to regulate a polymer solution. This polymer solution is sprayed from a nozzle and heated so as to Ivaporize the organic solvent, thereby producing polymer microparticles.

When the previously described polymer microparticles are used as toner particles in a liquid developer, the polymer microparticles are washed and dried, and have added thereto additives such as well-known charge-regulating agents, dispersion enhancing agents, resins and the like as required. Dispersion may also be accomplished by using an ultrasonic dispersion device in the liquid medium.

Examples of coloring agents useful with the aforesaid toner particles are carbon black, phthalocyanine and like pigments, but are not limited to these examples, inasmuch as stains or colored resins may be used to similar effect.

Resins useful for comprising the toner particles are not specifically restricted and may include, for example individual resins or blends thereof including polyester resins, styrene-acrylic resins copolymers, polystyrene, polyvinyl chloride, polyvinyl acetate, polymethacrylate ester, polyacrylate ester, epoxy resins, polyethylene, polyurethane, polyamide, paraffin wax and the like.

Various constituents may be added to the aforesaid resins such as charge-regulating agents, offset-preventing agents and the like as required.

Typically, an electrically insulative organic material is used as the liquid medium used in the liquid developer, which remains in its normal state as a liquid during development. Examples of useful insulative organic materials are hydrocarbon resins, alicyclic hydrocarbons, aromatic hydrocarbons, halogenated hydrocarbons, polysiloxane and the like. However, from the perspectives of nontoxicity, odor, cost and the like, isoparaffin solvent mediums are preferable.

More specifically, preferred materials are isobar-G, isobar-H, isobar-L, isobar-K (manufactured by Esso), Shelzol 71 (manfactured by Shell Sekiyu Kagaku K. K), IP solvent 1620, IP solvent 2028 (manufactured by Idemitsu Sekiyu Kagaku). Useable materials which are solids at normal temperature are types of wax, paraffins and the like.

Special developing methods may also be used such as the developing method disclosed in Japanese Examined Patent Application No. SHO 51-19988 wherein a liquid developer uses an aqueous type liquid medium. When the aforesaid developing method is used, the liquid medium need not be electrically insular, such that a low resistance solvent medium such as water may be used.

The density of toner particles in the liquid medium is desirably 0.5–50 percent by weight, and preferably 2–10 percent by weight in order to achieve effective development, improve developing speed, and reduce fogging.

Additive agents such as charge-regulating agents, dispersion agents, dispersion stabilizers and the like may be added as required to the liquid medium of the liquid developer.

Well-known charge-regulating agents may be used. In order to charge toner particles with a positive polarity, soluble polymers may be used such as, for example, metal salts of fatty acids such as stearin, metal salts of sulfosuccinic acid, metal salts of organic acids such as abietic acid, or alkyd resins which is absorbed by particles. In order to charge toner particles with a negative polarity, soluble polymers may be used such as, for example, surface-active agents such as lecithin, nitrogen compounds, or polyamide resins absorbed by the particles. The aforesaid charge-regulating agents are desirably added to the liquid medium at a rate of 0.0001–10 percent by weight, and preferably 0.001–3 percent by weight.

Other charge-enhancing agents having a similar weight as the charge-regulating agent may be added, including metallic oxides such as $SiO_2$, $Al_2O_3$, $TiO_2$, ZnO and the like.

Various surface-active agents and soluble polymers may be used as dispersion agents and dispersion stabilizers to stabilize the dispersion of toner particles within the liquid developer.

Soluble polymers are not specifically restricted and may include, for example, polyolefin petroleum resins, linseed oil, polyalkylmethacrylate and the like, or low-weight monomers having a polar radical such as methacrylate, acrylate, alkylaminoethyl methacrylate and the like to increase the affinity with the polymer particles. Soluble polymers are desirably added to the liquid medium at a rate of 0.01–20 percent by weight, and preferably 0.1–10 percent by weight from the perspectives of improving dispersion and preventing the elevation of viscosity of the liquid medium due to said addition.

Examples of useful surface-active agents are-natural surface-actiVe agents such as saponin and the like, nonionic surface-active agents such as alkylene oxide, glycerine, glycidol and the like, and anionic surface-active agents having an oxide radical such as carbonic acid, sulfonic acid, phosphoric acid, sulfate radical, phosphate radical and the like.

Figure 3:
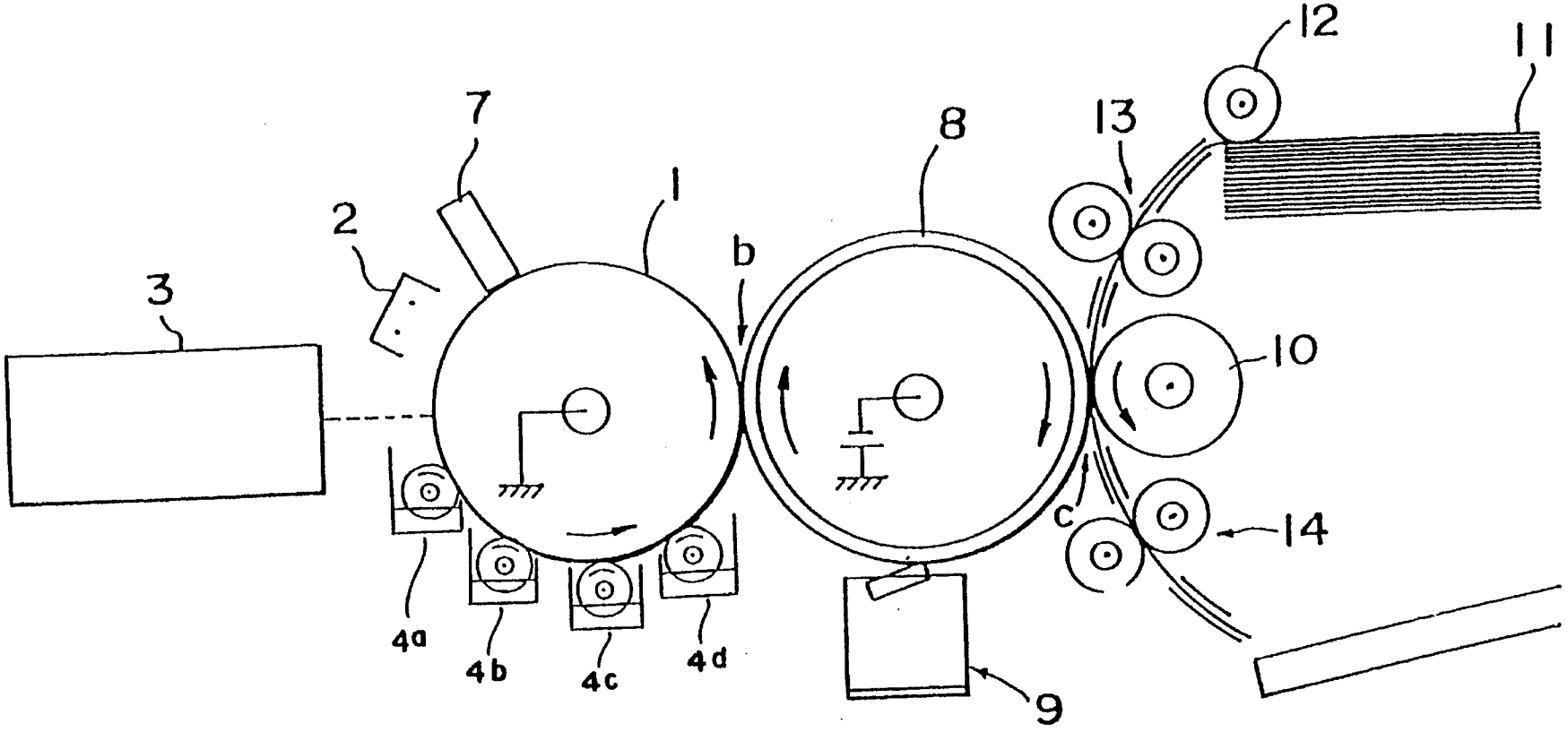
FIG. 3 is a brief illustration showing the full color image forming apparatus as another embodiment of the present invention.

Although FIG. 1 shows an image forming apparatus for forming monochrome images provided with a single developing device, it is to be understood that the embodiment of the present invention is not limited to such an arrangement insofar as the image forming apparatus may be provided with a plurality of developing devices to form full color images. Specifically, the present invention is also applicable to an image forming apparatus provided with three developing devices 4*a*, 4*b* and 4*c* respectively accommodating cyan toner, magenta toner, and yellow toner, or an image forming apparatus provided with four developing devices incorporating a developing device 4*d* accommodating black toner in addition to the aforesaid three other developing devices 4*a*, 4*b* and 4*c* as shown in FIG. 3. It is to be noted here that each of the developing devices 4*a*, 4*b*, 4*c* and 4*d* has the same structure as the devleoping device 4 as shown in FIG. 1. The present invention relates to an image forming apparatus provided with an intermediate transfer member, and is applicable in particular with image forming apparatus which reproduce full color images by overlaying each color using said intermediate transfer member.

Specific embodiments are described hereinafter.

Manufacture of Liquid Developer A

One hundred parts by weight low molecular weight polyester resin (Mw: 15,000; Mn: 6,000) were completely dissolved in methylene chloride to achieve a concentration of 20% by weight. Six parts by weight phthalocyanine were dispersed in the aforesaid resin solution as a coloring agent using an Eiger Motor Mill (Eiger Japan).

The resin solution obtained in the manner described above was placed in emulsion-dispersion in an aqueous fluid dispersion of 1% Metorouzu 65SH-50 (Shin-Etsu Chemical Co., Ltd.) and 1% sodium lauryl sulfate using a Homomixer (Tokushu Kika Kogyo K.K.) for 30 minutes at 8,000 rpm at room temperature to produce an emulsion of the O/W type. Then, the four mixing blades were replaced, and the methylene chloride was removed while mixing for 3 hours at 40°–40°–45° C., so as to obtain an aqueous suspension of toner polymer microparticles having a volume-average particle size of 2 μm.

Solids were removed from the aforesaid aqueous suspension of toner polymer-microparticles by means of a centrifuge, thoroughly washed with water, filtered and dried to obtain toner polymer microparticles having a volume-average particle size of 2 μm.

Three parts by weight of the aforesaid toner polymer microparticles are added to 100 parts by weight electrically insular isoparaffin solvent IP solvent 1620 (Idemitsu Sekiyu Kagaku). To this suspension were added 3 parts by weight lauryl methacrylate-methacrylic acid and 0.5 parts by weight dihydro aluminum abietate, which was mixed for dispersion for 20 minutes via an ultrasonic dispersion device so as to obtain liquid developer A having a dispersion of toner polymer microparticles with a volume-average particle size of 2 μm.

Manufacture of Liquid Developer B

Materials were prepared in the same manner as described in the manufacture of liquid developer A with the exception that emulsion-dispersion was performed for 30 minutes at 12,000 rpm using a Homomixer. The obtained liquid developer B had a dispersion of toner polymer microparticles having a volume-average particle size of 0.5 μm.

Manufacture of Liquid Developer C

Materials were prepared in the same manner as described in the manufacture of liquid developer A with the exception that emulsion-dispersion was performed for 30 minutes at 6,000 rpm using a Homomixer. The obtained liquid developer C had a dispersion of toner polymer microparticles having a volume-average particle size of 4 μm.

Manufacture of Liquid Developer D

Materials were prepared in the same manner as described in the manufacture of liquid developer A. The obtained liquid developer had a dispersion of toner polymer microparticles having a volume-average particle size of 2 μm.

The obtained liquid developer was forcibly mixed together with glass beads of equal volume (diameter 1.0 mm), to obtain a liquid developer D having toner particles deformed to a flatness within the developer. The degree of the aforesaid flatness was measured by changing the angle of toner SEM observation, and measuring the longest diameter and shortest diameter and comparing same. This toner had a volume-average particle size of 2 μm, and the degree of flatness was 30.

Manufacture of Liquid Developer E

Materials were prepared in the same manner as described in the manufacture of liquid developer A with the exception that emulsion-dispersion was performed for 30 minutes at 7,000 rpm using a Homomixer. The obtained liquid developer E had a dispersion of toner polymer microparticles having a volume-average particle size of 3 μm.

TABLE 1

| | Developer A | Developer B | Developer C | Developer D | Developer E |
|---|---|---|---|---|---|
| Mixing speed | 8,000 rpm | 12,000 rpm | 6,000 rpm | 8,000 rpm | 7,000 rpm |
| Mixing time | 30 min | 30 min | 30 min | 30 min | 30 min |
| Mean particle diameter | 2 μm | 0.5 μm | 4 μm | 2 μm | 3 μm |
| Flatness | Spherical | Spherical | Spherical | 30 | Spherical |

Manufacture of Intermediate Transfer

Member 1

Epichlorohydrin rubber provided with a conductivity via conductive carbon was formed on an aluminum tube 80 mm in diameter so as to form a major diameter of 88 mm. The specific resistance of the rubber at this time was $1.3\times10^6$ Ωcm. The aforesaid tube is then covered with PFA (ethylene tetrafluoride-perfluoroalkoxyethylene copolymer) heat-shrink tube having a thickness of 100 μm and a specific resistance of $1\times10^9$ Ωcm, which was then heat-shrunk for 30 minutes at 150° C. for mounting. Then, the aforesaid tube was subjected to surface roughening using wool felt disk buffer (diameter 20 cm). Aluminum particles having a mean particle diameter of 8 μm were used as an abrasive.

The surface of the obtained intermediate transfer member 1 had a ten-point mean roughness Rz of 2.0 μm.

Manufacture of Intermediate Transfer

Member 2

Intermediate transfer member 2 was prepared in the same manner as described in the manufacture of intermediate transfer member 1 with the exception that polycarbonate resin of the bispheno Z-type having a mean particle diameter of 5 μpm was used as an abrasive.

The surface of the obtained intermediate transfer member 2 had a ten-point mean roughness Rz of 1.0 μm.

Manufacture of Intermediate Transfer

Member 3

Intermediate transfer member 3 was prepared in the same manner as described in the manufacture of intermediate transfer member 1 with the exception that chrome oxide particles having a mean particle diameter of 75 μm was used as an abrasive.

The surface of the obtained intermediate transfer member 3 had a ten-point mean roughness Rz of 20 μm .

Manufacture of Intermediate Transfer

Member 4

Intermediate transfer member 4 was prepared in the same manner as described in the manufacture of intermediate transfer member 1 with the exception that aluminum oxide particles having a mean particle diameter of 90 μm was used as an abrasive.

The surface of the obtained intermediate transfer member 4 had a ten-point mean roughness Rz of 25 μm.

Manufacture of Intermediate Transfer

Member 5

Intermediate transfer member 5 was prepared in the same manner as described in the manufacture of intermediate transfer member 1 with the exception that an FEP (tetrafluoroethylenehexafluoropropylene copolymer) heat-shrink tube having a thickness of 500 μm and specific resistance of $1\times10^8$ Ωcm was used as the surface overcoat layer, and surface roughening was not performed.

The surface of the obtained intermediate transfer member 5 had a ten-point mean roughness Rz of 0.5 μm.

Manufacture of Intermediate Transfer

Member 6

Intermediate transfer member 6 was prepared in the same manner as described in the manufacture of intermediate transfer member 5 with the exception that buff grinding was performed using aluminum oxide particles having a mean particle diameter of 130 μm.

The surface of the obtained intermediate transfer member 6 had a ten-point mean roughness Rz of 30 μm.

Manufacture of Intermediate Transfer

Member 7

Intermediate transfer member 7 was prepared in the same manner as described in the manufacture of intermediate transfer member 1 with the exception that buff grinding was performed using aluminum oxide particles having a mean particle diameter of 10 μm was used as an abrasive.

The surface of the obtained intermediate transfer member 7 had a ten-point mean roughness Rz of 2.5 μm.

Evaluations

The previously described intermediate transfer members were evaluated in the image forming apparatus shown in FIG. 1 under the conditions described hereinafter.

Photosensitive drum surface potential: −1,000 V (approximate)

Developing roller rotation speed/photosensitive drum rotation speed: 10

Intermediate transfer member applied voltage: −1000 V

Transfer roller temperature: 200° C.

Primary transfer pressure: 130 gf/cm

Secondary transfer pressure: 1 Kgf/cm

Primary Transfer Characteristics

Using the previously described image forming apparatus, solid images were output and the amount of toner adhered to the intermediate transfer member was measured before and after transfer. The ranking listed below were created to investigate transfer efficiency; rankings of Δ and above were acceptable. Primary transfer efficiency= amount of toner adhered to the surface of the intermediate transfer member/amount of toner adhered to the surface of the photosensitive drum ⊙: Primary transfer efficiency 95% or higher ○:Primary transfer efficiency 80% or higher, but less than 95% Δ:Primary transfer efficiency 60% or greater, but less than 80% ×: Primary transfer efficiency less than 60%

Secondary Transfer Characteristics

Using the previously described image forming apparatus, solid images were output and transferred onto recording sheets. Subsequently, the amount of toner adhered to the recording sheet and the amount of residual toner remaining on the surface of the intermediate transfer member were measured. The ranking listed below were created to investigate transfer efficiency; rankings of Δ and above were acceptable.

Secondary transfer efficiency= amount of toner adhered to the surface of the recording sheet/(amount of toner adhered to the surface of the recording sheet+ amount of residual toner remaining after transfer) ⊙Secondary transfer efficiency 95% or higher ○Secondary transfer efficiency 80% or higher, but less than 95% Δ: Secondary transfer efficiency 60% or greater, but less than 80% ×: Secondary transfer efficiency less than 60%

Resolution

Using the previously described image forming apparatus, one-dot ON/OFF vertical lines were exposed at 300 dots per inch (DPI) via a laser optical unit, developed, and subjected to primary and secondary transfers. Subsequently, the image on the recording sheet was examined by microscope. Resolution was differentiated by the rankings below by determining whether or not the aforesaid lines were visibly separated; rankings of o and above were acceptable. ⊙: Lines are visibly separated Δ: Parts of the lines are not separated ×: Lines are not separated –: Determination impossible due to poor transfer efficiency; satisfactory image unobtainable The previously described intermediate transfer members 1–7 and liquid developers A-E were evaluated in combination via experimentation. The resulting evaluations are shown in Table 2.

TABLE 2

| | Interm. transfer member | Developer | Primary transfer efficiency | Secondary transfer efficiency | Resolution | Overall evaluation |
|---|---|---|---|---|---|---|
| Example 1 | 1 | A | ⊙ | ⊙ | ○ | ○ |
| Example 2 | 2 | A | ⊙ | ⊙ | Δ | Δ |
| Example 3 | 3 | A | Δ | Δ | ○ | Δ |
| Ref. Ex. 1 | 4 | A | X | Δ | — | X |
| Ref. Ex. 2 | 5 | A | ⊙ | ⊙ | X | X |
| Ref. Ex. 3 | 6 | A | X | X | — | X |
| Example 4 | 7 | B | ○ | ○ | ○ | ○ |
| Example 5 | 1 | C | ⊙ | ⊙ | Δ | Δ |
| Example 6 | 1 | D | ⊙ | ⊙ | ○ | ○ |
| Example 7 | 6 | E | Δ | Δ | ○ | Δ |

As can be readily understood from the above Examples and Reference Examples, an intermediate transfer device is provided which has excellent resolution and transfer efficiency by providing an intermediate transfer member having a surface roughness that is 0.5–10 times the volume-average particle size of the toner particles.

That is, when the surface roughness of the intermediate transfer member is less than 0.5 times the volume-average particle size of the toner, toner cannot be maintained with stability on the surface of the intermediate transfer member, such that said toner is readily moved horizontally due to the pressure exerted thereon during transfer. Therefore, resolution is thereby reduced.

Conversely, when the surface roughness of the intermediate transfer member is greater than 10 times the volume-average particle size of the toner, a space is formed between the intermediate transfer member and electrostatic latent image carrying member during primary transfer. This situation is disadvantages insofar as it makes it difficult to form the electric field required for the aforesaid transfer, increases the time necessary for toner movement, and allows air to mix in the aforesaid space. Therefore, primary transfer efficiency is markedly reduced. Since a similar disadvantage arises in the secondary transfer, the secondary transfer efficiency is also reduced.

Even when the surface roughness of the intermediate transfer member is less than 10 times the volume-average particle size of the toner, there is a tendency for disadvantages to arise with respect to transfer efficiency when the absolute value exceeds 20 μm, and, therefore, it is desirable that said absolute value be less than 20 μm.

Although the present invention has beeh fully described by way of examples with reference to the accompanying drawings, it is to be noted that various changes and modifications will be apparent tO those skilled in the art. Therefore, unless otherwise such changes and modifications depart from the scope of the present invention, they should be construed as being included therein.

What is claimed is:

1. An image forming apparatus comprising:

an image carrying member on the surface of which is maintained an electrostatic latent image;

a developing device that accommodates a liquid developer including toner particles, said electrostatic latent image being developed by the toner particles to be a toner image;

an intermediate transfer member onto which is transferred the toner image formed on the surface of the image carrying member to be maintained thereon, a mean roughness of said intermediate transfer member surface being 0.5–10 times greater than the volume-average particle size of the toner particles; and a transfer device that transfers the toner image on the surface of the intermediate transfer member onto a recording medium.

2. An image forming apparatus as claimed in claim 1 wherein toner particles included in the developer have the volume-average particle size of 0.5–5.0 μm.

3. An image forming apparatus as claimed in claim 1 wherein the intermediate transfer layer has at least surface layer formed of fluororesin.

4. An image forming apparatus as claimed in claim 1 wherein 80% of the volume of the total weight of toner particles is desirably regulated to ±1 μm of the volume-average mean particle size.

5. An image forming apparatus as claimed in claim 1 wherein said developer comprises a liquid medium used as a liquid carrier and toner particles of polymer microparticles incorporating a coloring agent.

6. An image forming apparatus as claimed in claim 5 wherein the density of toner particles in the liquid medium is desirably 0.5–50 percent by weight.

7. An image forming apparatus as claimed in claim 5 wherein said liquid medium is composed of materials of hydrocarbon resins, alicyclic hydrocarbons, aromatic hydrocarbons, halogenated hydrocarbons, or polysiloxane.

8. An image forming apparatus as claimed in claim 5 wherein said liquid medium includes dispersion stabilizers of surface-active agents or soluble polymers.

9. An image forming apparatus comprising:

an image carrying member on the surface of which is maintained an electrostatic latent image;

a plurality of developing devices each of which accommodates liquid developer including toner particles for developing the electrostatic latent image to form a toner image, the color of the toner particles included in the liquid developer accommodated in each of the developing devices being different;

an intermediate transfer member onto which are sequentially transferred the toner images formed on the surface of the image carrying member to form a color toner image maintained thereon, a mean roughness of said intermediate transfer member surface being 0.5–10 times greater than the volume-average particle size of the toner particles; and a transfer device that transfers the color toner image on the surface of the intermediate transfer member to a recording medium.

10. An image forming apparatus as claimed in claim 9 wherein toner particles included in each of the developers have the volume-average particle size of 0.5–5.0 μm.

11. An image forming apparatus as claimed in claim 9 wherein the intermediate transfer layer has at least a surface layer formed of fluororesin.

12. An image forming apparatus as claimed in claim 9 Wherein 80% of the volume of the total weight of toner particles is desirably regulated to ±1 μm of the volume-average mean particle size.

13. An image forming apparatus as claimed in claim 9 wherein each of the developers comprises a liquid medium used as a liquid carrier and toner particles of polymer microparticles incorporating a coloring agent.

14. An image forming apparatus as claimed in claim 13 wherein the density of toner particles in the liquid medium is desirably 0.5–50 percent by weight.

15. An image forming apparatus as claimed in claim 13 wherein said liquid medium is composed of materials of hydrocarbon resins, alicyclic hydrocarbons, aromatic hydrocarbons, halogenated hydrocarbons, or polysiloxane.

16. An image forming apparatus as claimed in claim 13 wherein said liquid medium includes dispersion stabilizers of surface-active agents or soluble polymers.

17. A method performed in an image forming apparatus comprising an image carrying member, and a developing device accommodating liquid developer which includes toner particles for forming a toner image by developing an electrostatic latent image on the image carrying member, said method comprising:

providing an intermediate transfer member onto which is transferred the toner image formed on the surface of the image carrying member; and providing a surface having a mean roughness 0.5–10 times greater than the volume-average particle size of the toner particle on said intermediate transfer member.

18. A method as claimed in claim 17 wherein said surface provided on the intermediate transfer member is formed by grinding using particles, buff grinding, brush grinding, water grinding via the interposition of a liquid, liquid grinding, sandblasting via impact by high-sped particles, heat processing during formation of the surface coating of the intermediate transfer layer, or solvent processes.

19. In an image forming apparatus which forms an electrostatic latent image on an image carrying member, applies a liquid developer including toner particles to said electrostatic latent image to form a toner image on the image carrying member, transfers the toner image from the image carrying member onto an intermediate transfer member and transfers the toner image from the intermediate transfer member onto a recording medium, said intermediate transfer member comprising a surface on which the toner image is transferred, a mean roughness of said surface being 0.5–10 times greater than the volume-average particle size of the toner particles.

20. An intermediate transfer member as claimed in claim 19 wherein said surface of the intermediate transfer member comprises fluororesin.

21. An intermediate transfer member as claimed in claim 20 wherein said intermediate transfer member comprises a first layer including the surface on which the toner image is transferred, and a second layer formed of conductive material.

22. An intermediate transfer member as claimed in claim 21 wherein said intermediate transfer member further comprises a third layer provided between said first layer and the second layer, said third layer formed of electrically conductive rubber material.

* * * * *